US005539285A

United States Patent [19]

Iguchi et al.

[11] Patent Number: 5,539,285

[45] Date of Patent: Jul. 23, 1996

[54] CATHODE-RAY TUBE WITH ELECTRIC FIELD CORRECTION LENS FOR IMPROVED RESOLUTION

[75] Inventors: Yukinobu Iguchi; Nobuya Okano, both of Kanagawa, Japan

[73] Assignee: Sony Corporation, Tokyo, Japan

[21] Appl. No.: 250,539

[22] Filed: May 31, 1994

[30] Foreign Application Priority Data

Jun. 1, 1993 [JP] Japan ..... 5-130752

[51] Int. Cl.[6] ..... G09G 1/04; H01J 29/50

[52] U.S. Cl. ..... 315/382; 313/414

[58] Field of Search ..... 315/382; 313/414

[56] References Cited

U.S. PATENT DOCUMENTS

Re. 34,339 10/1993 Osakabe ..... 315/382

5,055,749 10/1991 Chen et al. ..... 315/382

5,325,013 6/1994 Johnson et al. ..... 313/414

5,347,202 9/1994 Stil ..... 315/382

*Primary Examiner*—Gregory C. Issing

*Attorney, Agent, or Firm*—Jay H. Maioli

[57] ABSTRACT

A cathode ray tube includes a sixth grid ($G_6$), which is a final accelerating electrode, of first to sixth grids ($G_1$ to $G_6$) forming an electron gun and the sixth grid (1) is divided into three electrodes ($G_{6a}$, $G_{6b}$ and $G_{6c}$). Longitudinally oblong opening portions (9 and 11) are formed through the first and third electrodes ($G_{6a}$ and $G_{6c}$), and a laterally oblong opening portion (10) is formed through the second electrode ($G_{6b}$). A dynamic voltage is supplied to the electrode ($G_{6b}$) through a neck capacitor (19) formed at a neck portion (2*a*) of the cathode-ray tube (2) to thereby form a quadrupole-lens electric field (7) for correction of deformation of a beamspot on the side of a deflection yoke relative to a main-lens electric field (8).

10 Claims, 14 Drawing Sheets

CATHODE-RAY TUBE WITH ELECTRIC FIELD CORRECTION LENS FOR IMPROVED RESOLUTION

BACKGROUND OF THE INVENTION

1. Field of the Invention

The present invention relates to a cathode-ray tube for use in, for example, a color television, a color display apparatus or the like.

2. Description of the Prior Art

A resolution characteristic of a color cathode-ray tube generally depends largely upon the size and shape of the beam spot. That is, if the diameter of the beam spot generated on a fluorescent screen by collision of an electron beam thereon is neither small nor substantially perfectly circular, then a satisfactory resolution characteristic cannot be obtained. A cathode-ray tube in which a static quadrupole lens is provided in order to improve a focus at the periphery of the screen is disclosed in U.S. applications Nos. 974714 filed Nov. 12, 1992 and 976391 filed Nov. 13, 1992.

However, since an orbit of the electron beam from an electron gun to the fluorescent screen becomes long in response to a deflection angle of the electron gun, if a focus voltage is maintained so that a small and perfectly circular beam spot should be obtained at the center of the fluorescent screen, then a peripheral portion of the fluorescent screen is brought in an over-focus state, with the result that the beam spot having a small diameter cannot be obtained at the peripheral portion thereof and hence satisfactory resolution cannot be obtained.

Therefore, there has been recently proposed an electron gun for the cathode-ray tube adopting a so-called dynamic focus system in which the focus voltage is increased and a main-lens action is lowered in response to an increase of the deflection angle of the electron beam (for example, Shoji Shirai, Masakazu Fukushima et al.: Quadrupole Lens for Dynamic Focus and Astigmatism Control in an Elliptical Aperture Lens Gun, Proceeding SID 87 DIGEST P162–165, and Japanese Laid-open Patent Publication NO. 93135/1991).

However, such prior art encounters the following problems.

That is, in case of the above Proceeding SID 87 Digest, for example, a dynamic quadrupole lens for lowering the main-lens action is formed on the side of a cathode relative to the main lens, so that a distance between a deflection yoke, which is a portion where a spot deformation itself is caused, and a correction point becomes long. Accordingly, a dynamic focus voltage upon the correction becomes high to increase load on a correction circuit, and an aspect ratio of the beam spot upon a dynamic correction becomes aggravated (a length in a lateral direction becomes long and a length in a longitudinal direction becomes short).

On the other hand, in the above Japanese Laid-open Patent Publication, it is proposed to improve the aspect ratio of the spot upon the correction by combining two quadrupole lenses. However, since the quadrupole lenses are formed on the cathode side relative to the main lens lengthen the beam spot, the above-mentioned problem cannot be sufficiently improved. Even in this case, the main effect thereof is to in the longitudinal direction, so that the length in the lateral direction thereof is prevented from becoming short. Therefore, as a result, there is then the disadvantage that the resolution is not improved.

OBJECT AND SUMMARY OF THE INVENTION

The present invention is made in view of such aspect of the prior arts, and an object thereof is to provide the cathode-ray tube which can lower the dynamic focus voltage and shape the beam spot into a substantially perfect circle.

According to an aspect of the present invention, in an electron gun for a cathode-ray tube in which there are formed a main-lens electric field for focusing an electron beam on a fluorescent screen and a correction-lens electric field for correcting a spot deformation of the electron beam resulting from a deflection magnetic field formed between the main-lens electric field and the fluorescent screen, the correction-lens electric field is formed on the side of the deflection magnetic field relative to the main lens electric field.

In this case, a correction-lens electric field for correction of the spot deformation can further be formed between a cathode for emitting the electron beam and the main-lens electric field.

The correction-lens electric field can be formed by supplying a dynamic voltage to a correction electrode through a capacitor formed by using a neck glass of a cathode-ray tube as a dielectric.

Further, the correction-lens electric field can be formed by subjecting to a dynamic modulation a high-voltage side electrode of the electrodes for forming the main-lens electric field.

DETAILED DESCRIPTION OF THE PREFERRED EMBODIMENTS

Embodiments of an electron gun for a cathode-ray tube according to the present invention will hereinafter be explained with reference to FIGS. 1A to 11.

Figure 1A:
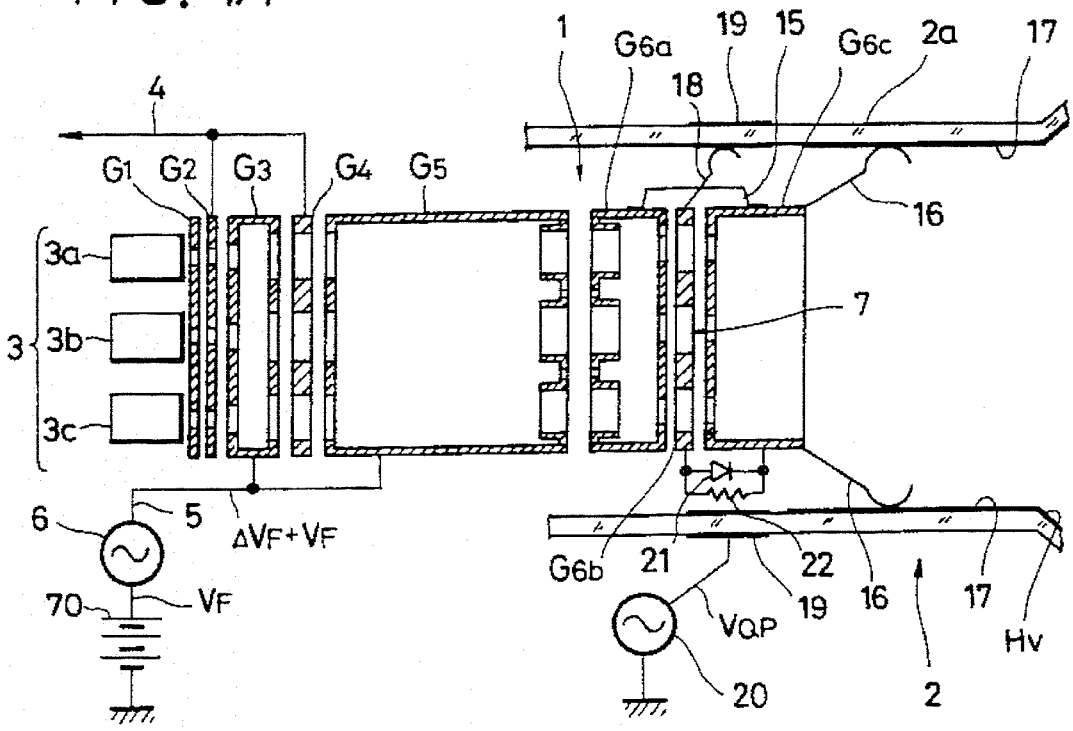
FIG. 1A is a cross-sectional view showing construction of the whole of a first embodiment according the present invention.
Figure 1B:
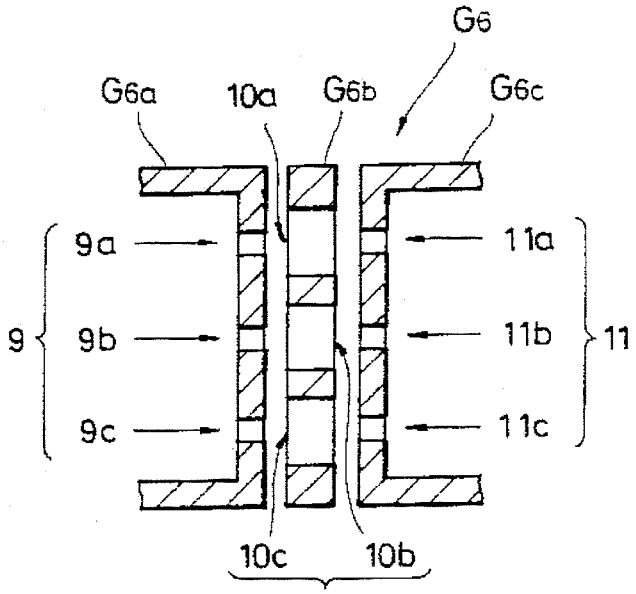
FIG. 1B is a cross-sectional view showing construction of an essential part of the above embodiment.

FIGS. 1A and 1B show construction of the first embodiment according to the present invention. As shown in FIG. 1A, an electron gun 1 according to the present embodiment is an inline three electron gun for a color cathode-ray tube and disposed in a neck portion 2*a* of a cathode-ray tube 2. The electron gun 1 is arranged such that a cathode 3 and first to sixth grids $G_1$ to $G_6$ are successively disposed in the direction toward a screen (not shown) of the cathode-ray tube 2 from the neck portion 2*a* thereof. A deflection yoke not shown is disposed on the screen side of the electron gun 1.

As shown in FIG. 1A, the cathode 3 is constructed by arranging cathodes 3*a* to 3*c* for emitting electron beams of respective colors in an inline fashion, for example.

The first to sixth grids $G_1$ to $G_6$ are disposed on the same axis (Z axis). The first to fifth grids $G_1$ to $G_5$ are electrodes having publically known construction. The first grid $G_1$ is a control grid electrode. The second and fourth grids $G_2$ and $G_4$ are accelerating electrodes. The third and fifth grids $G_3$ and $G_5$ are focusing electrodes. Though reference numerals are not given, beam transmission apertures used for transmission of the electron beams therethrough are formed through the first to fifth grids $G_1$ to $G_5$. Further, the second and fourth grids $G_2$ and $G_4$ are connected to each other through a lead 4 and supplied with a voltage for accelerating the electron beams. On the other hand, the third and fifth grids $G_3$ and $G_5$ are connected to a dynamic-focus-voltage generating circuit 6 through a lead 5, and the dynamic-focus-voltage generating circuit 6 is connected to a direct-current power source 70.

The sixth grid $G_6$ is used for forming a quadrupole lens electric field 7 for correction and is formed of three electrodes, that is, a first electrodes $G_{6a}$, a second electrode $G_{6b}$ and a third electrode $G_{6c}$. In the present embodiment, a main-lens electric field for focusing the electron beams is formed by the fifth grid $G_5$ and the first electrode $G_6$a.

Opening portions as shown in FIG. 1B, for example, are formed through each of the electrodes $G_{6a}$ to $G_{6c}$ forming the sixth grid $G_6$. That is, opening apertures 9 (9*a*, 9*b* and 9*c*) corresponding to respective electron beams are formed through the first electrode $G_{6a}$ on the screen side thereof, while opening apertures 10 (10*a*, 10*b* and 10*c*) and 11 (11*a*, 11*b* and 11*c*) each corresponding to the respective electron beams are respectively formed through the second and third electrodes $G_{6b}$ and $G_{6c}$. The opening portions 11 of the third electrode $G_{6c}$ are formed through a portion thereof on the side of the cathode 3.

Figure 2A:
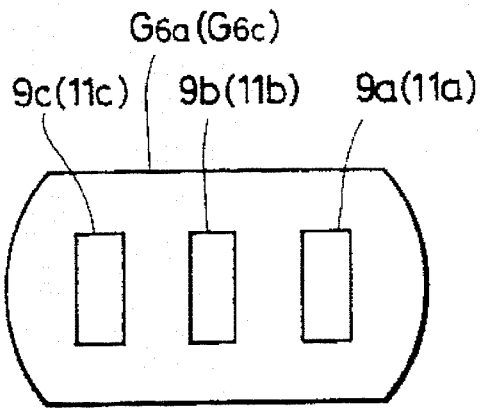
FIGS. 2A–2E are explanatory diagrams showing a shape of an opening portion used for forming a quadrupole-lens electric field of the above embodiment.
Figure 2B:
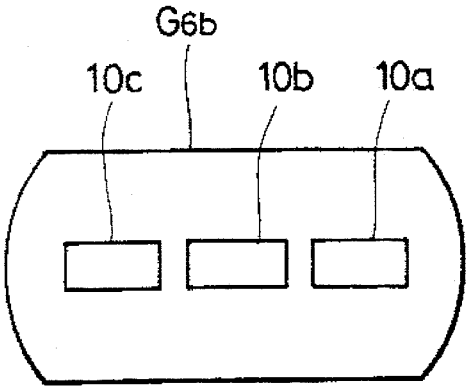

In the present embodiment, the opening portions 9 of the first electrode $G_{6a}$ on the screen side and the opening portions 11 of the third electrode $G_{6c}$ are formed so as to have longitudinally oblong shapes as shown in FIG. 2A, while the opening portions 10 of the second electrode $G_{6b}$ are formed so as to have laterally oblong shapes as shown in FIG. 2B. If a voltage supplied to the second electrode $G_{6b}$ is lower than voltages supplied to the first and third electrodes $G_{6a}$ and $G_{6c}$, then there is produced a so-called quadrupole effect which produces an asymmetrical shape relative to an axis in such a manner that the lens serves as a convex-lens in the longitudinal (vertical) direction relative to a beam spot and as a concave lens in the lateral (horizontal) direction relative to the beam spot.

Figure 2C:
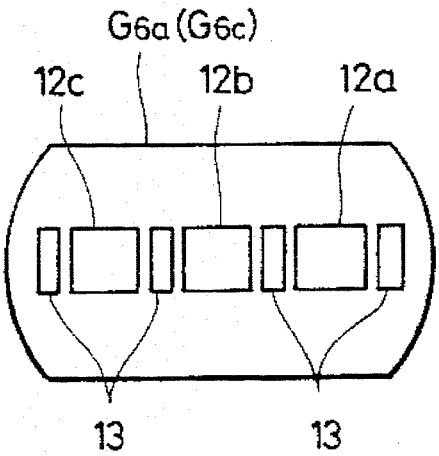
Figure 2D:
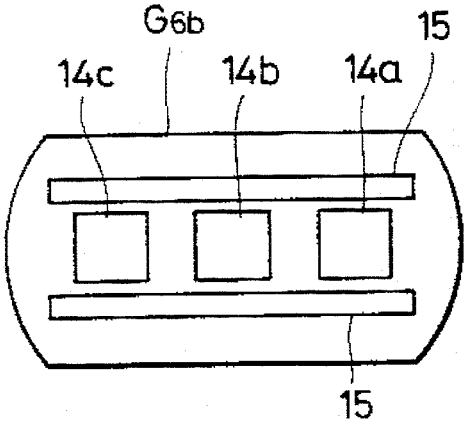
Figure 2E:
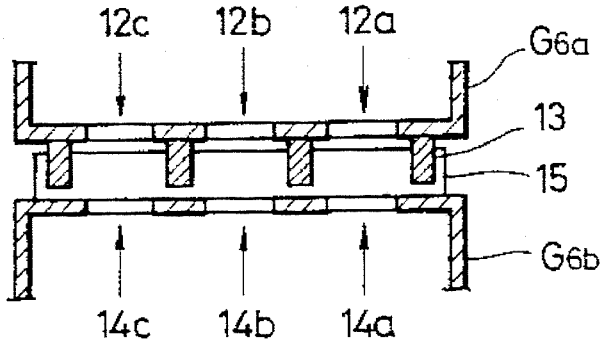

The opening portions 9 to 11 of the respective electrodes $G_{6a}$ to $G_{6c}$ may be formed as shown in FIGS. 2C to 2E, for example. That is, substantially square-shaped opening portions 12*a* to 12*c* are formed through the first and third electrodes $G_{6a}$ and $G_{6c}$, and eaves 13 in the longitudinal direction are formed at both sides of each of opening portions 12*a* to 12*c* and at portions between the adjacent opening portions 12*a* to 12*c*. On the other hand, the same opening portions 14*a* to 14*c* similar to those of the first and third electrodes $G_{6a}$ and $G_{6c}$ are formed through the second electrode $G_{6b}$, and eaves 15 extended in the lateral direction are formed at upper and lower sides of the opening portions 14*a* to 14*c*.

As shown in FIG. 1A, the first and third electrodes $G_{6a}$ and $G_{6c}$ are electrically connected to each other through a lead 15. The third electrode $G_{6c}$ is connected through a connection member 16 to an inside conductive film 17 formed on an inner surface of a tube body. The inside conductive film 17 is connected to an anode button not shown, whereby the first and third electrodes $G_{6a}$ and $G_{6c}$ are kept at an anode voltage $H_v$.

On the other hand, the second electrode $G_{6b}$ is connected through a connection member 18 to a neck capacitor 19. The neck capacitor 19 is a capacitor which consists of an electrode formed in a ring shape by using a neck glass at the neck portion 2*a* of the cathode-ray tube 2 as a dielectric and is constructed so as to have electrostatic capacity of about several tens pF, for example. The neck capacitor 19 is supplied from a dynamic-voltage generating circuit 20 provided at the outside of the cathode-ray tube 2 with a modulated voltage $V_{QP}$ synchronized with a deflection period, by which the voltage at the second electrode $G_{6b}$ is modulated.

Figure 3A:
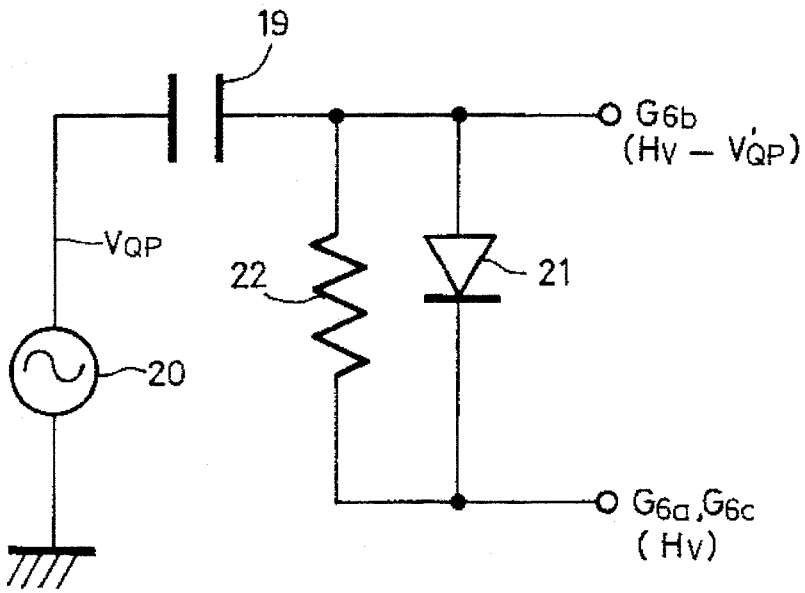
FIG. 3A is a diagram of an equivalent circuit of a dynamic-voltage supply circuit used in the above embodiment.

A high voltage-resistant diode (having a reverse voltage resistance of about 1 KV or more) 21 and a resistor 22 having high resistance (of about several tens MΩ) are connected in parallel between the second and third electrodes $G_{6b}$ and $G_{6c}$. In this case, the polarity of the diode 21 is selected such that the side on the second electrode $G_{6b}$ should serve as an anode and the side on the first and third electrodes $G_{6a}$ and $G_{6c}$ should serve as a cathode, whereby an equivalent circuit as shown in FIG. 3A is constructed.

Figure 3B:
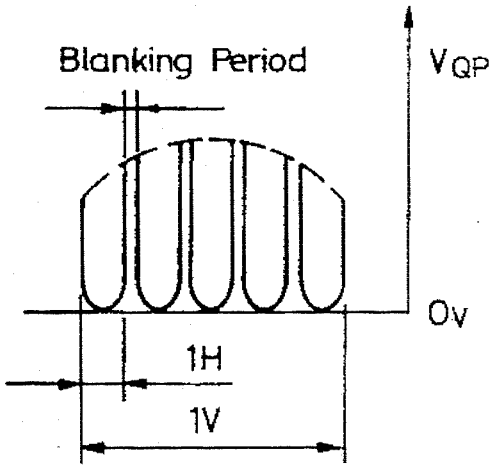
FIG. 3B is a diagram of an input waveform of the above dynamic-voltage supply circuit.

In this case, as an input waveform of the dynamic voltage, there is employed a pseudo-parabolic input waveform on which a pulse waveform is superposed at a blanking period thereof and which is synchronized with horizontal and vertical deflection periods. This waveform may be deformed waveform, and it is not necessary that the waveform is subjected to a CD clamp at 0 V as shown in FIG. 3B.

Figure 3C:
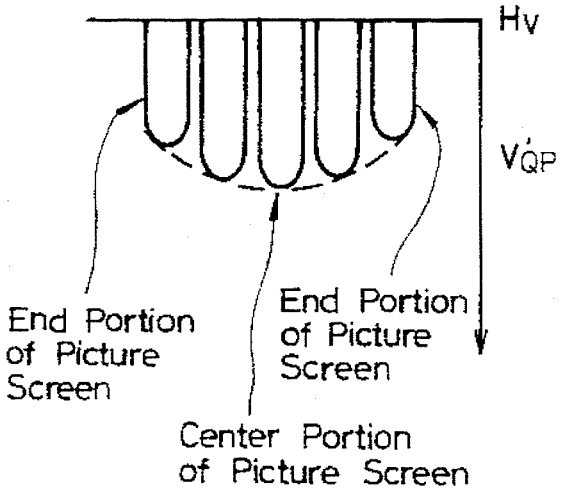
FIG. 3C is a diagram of an output waveform of an electrode $G_{6b}$ of the above dynamic-voltage supply circuit.

According to such equivalent circuit, as shown in FIG. 3C, the second electrode $G_{6b}$ is supplied therefrom with a voltage having a waveform which is clamped so that a maximum voltage thereof should be equal to $H_v$. The voltage of the second electrode $G_{6b}$ is dynamically modulated as described above, whereby there can be produced the dynamically modulated quadrupole-lens electric field 7 necessary for every portion on the picture screen.

In case of the present embodiment, since an concave-lens action always acts on a center portion of the picture screen in the lateral direction, the concave-lens action is required to be canceled in such a manner that the opening portions on the main-lens side of the first electrode $G_{6a}$ are formed so as to have a longitudinally oblong shape and hence a convex-lens action is intensified, for example.

Further, in the present embodiment, a focus voltage $V_F$ for forming the main-lens electric field 8 is subjected to dynamic modulation ($\Delta V_F$), whereby a spot shape at each position on the picture screen can be made optimum. In this case, if there is made such arrangement that the dynamic-voltage generating circuit 6 and the neck capacitor 19 are directly connected to each other to supply the dynamic-modulation voltage $\Delta V_F$ to the electrode $G_{6b}$, then there can be omitted the dynamic-voltage generating circuit 20 for supplying the dynamically modulated voltage $V_{QP}$.

Figure 4A:
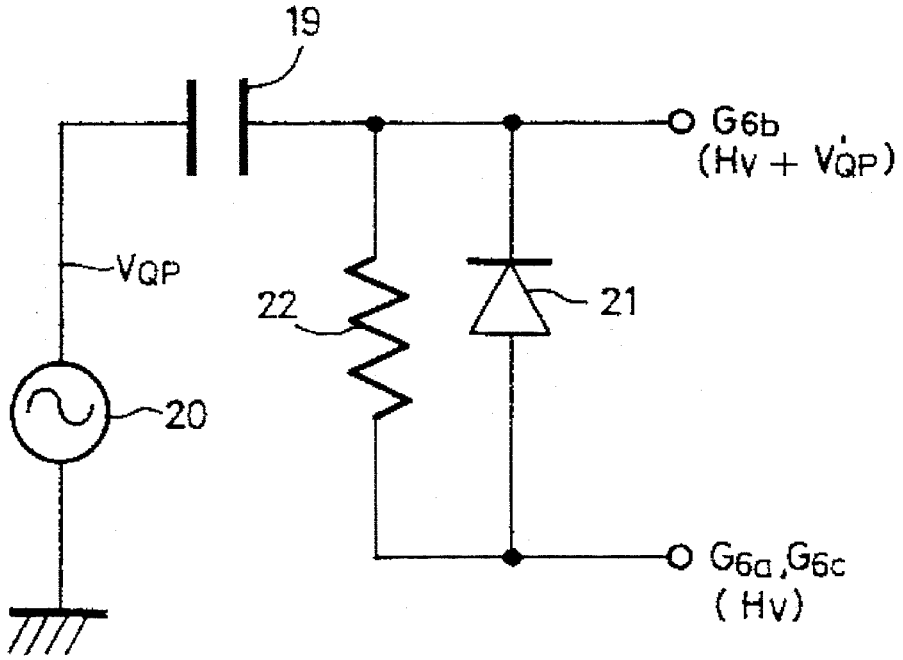
FIG. 4A is a diagram of an equivalent circuit of another example of a dynamic-voltage supply circuit used in the above embodiment.
Figure 4B:
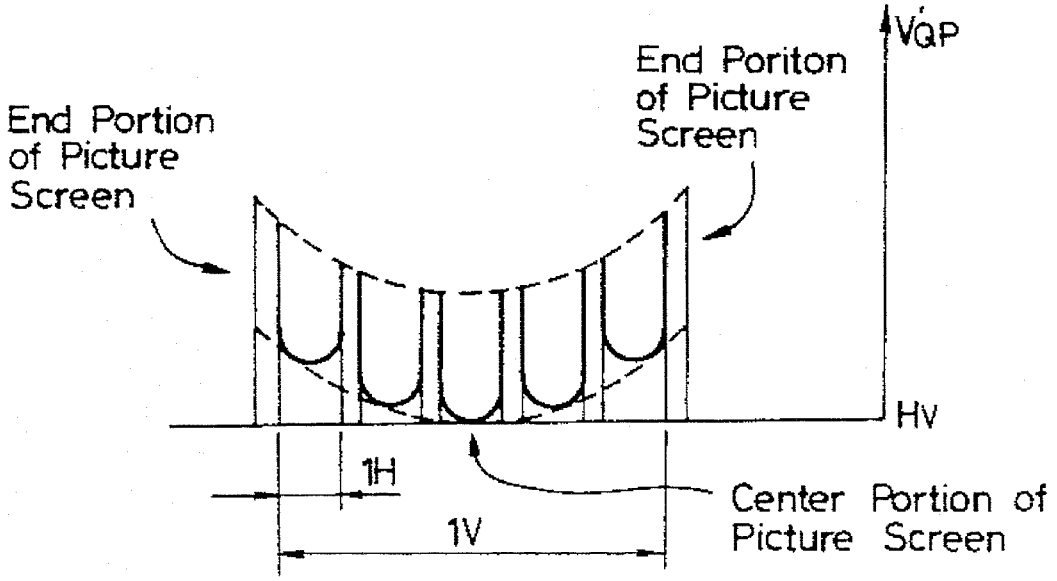
FIG. 4B is a diagram of the output waveform of an electrode $G_{6b}$ of the above dynamic-voltage supply circuit.

In the present embodiment, as shown in FIG. 4A, there can be used the dynamic-voltage supply circuit in which the polarity of the diode 21 is inverted. If this dynamic-voltage supply circuit is used, then a voltage $V'_{QP}$ which becomes minimum at the center portion of the picture screen as compared with the dynamically modulated voltage $V_{QP}$ as shown in FIG. 4B is supplied to the electrode $G_{6c}$, so that the convex-lens action at the center portion of the picture screen is canceled. As a result, there is then the advantage that it is not required to adjust the shape of the opening on the main-lens side of the electrode $G_{6a}$, for example.

Action and effect of the present embodiment will next be explained by comparing the same with the prior art. In this case, the prior art will be explained by giving the same reference numerals to portions corresponding to the present embodiment.

Figure 5:
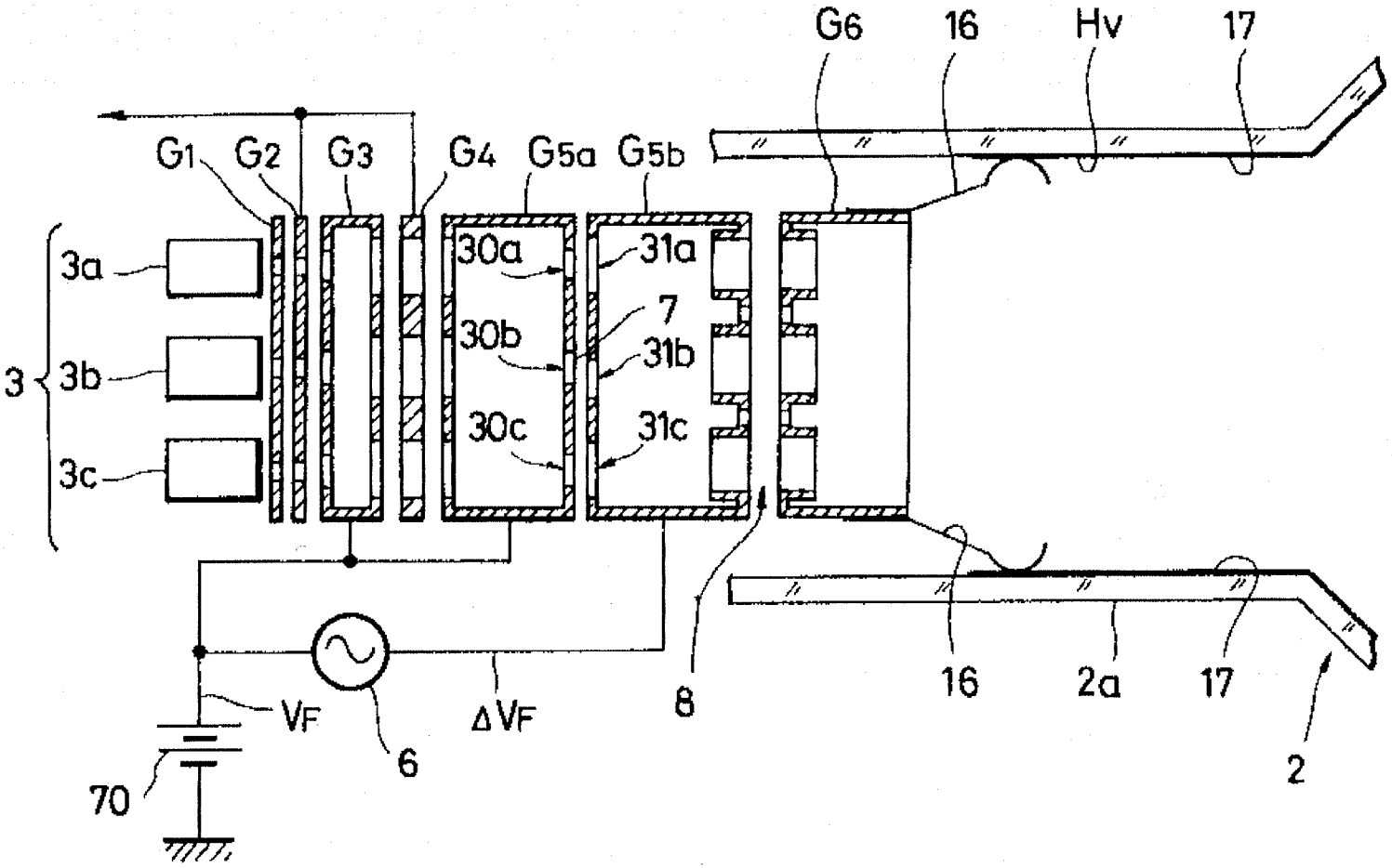
FIG. 5 (PRIOR ART)
FIG. 5 is a cross-sectional view showing construction of the whole of an electron gun according to the prior art.

FIG. 5 shows construction of the prior art. As shown in the same figure, in the prior art, there are disposed the cathode 3 and the first to fourth grids $G_1$ to $G_4$ which are similar to those of the present embodiment. The first and second electrodes $G_{5a}$ and $G_{5b}$ for forming a quadrupole-lens electric field 7 are provided between the sixth grid $G_6$, which is a final accelerating electrode, and the fourth grid $G_4$. Further, longitudinally and laterally oblong opening portions 30 (30*a* to 30*c*) and 31 (31*a* to 31*c*) are respectively formed through portions of first and second electrodes $G_{5a}$ and $G_{5b}$ which are opposed to each other. A focus voltage $V_F$ is supplied to the first electrode $G_{5a}$, while a modulated dynamic-voltage is supplied to the second electrode $G_{5b}$. An anode voltage $H_v$ is supplied to the sixth grid $G_6$. As a result, the main-lens electric field 8 is formed by the second electrode $G_{5b}$ and the sixth grid $G_6$. Further, the quadrupole-lens electric field 7 is formed by the first and second electrodes $G_5$ and $G_{5b}$. In this case, the quadrupole-lens electric field 7 is formed on the side of the cathode 3 relative to the main-lens electric field 7.

Figure 7A:
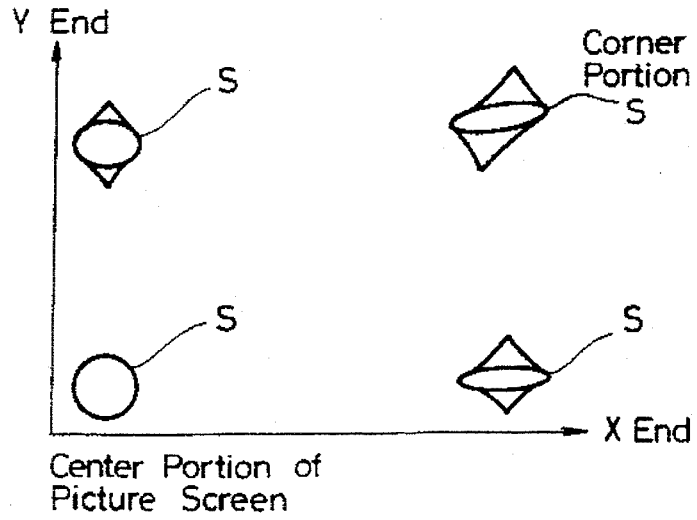
FIG. 7A (PRIOR ART)
FIGS. 7A–C are explanatory diagrams showing shapes of the beam spot according to the first embodiment and the prior art.

By the way, the electron beam is generally subjected to astigmatism action caused by a non-uniform magnetic field produced by a deflection yoke (in case of a horizontal deflection, for example, a non-uniform magnetic field of a pin cushion type is employed for correction of a misconvergence at a periphery of the picture screen), so that a shape of a beam spot S is deformed at each position on the picture screen as shown in FIG. 7A and hence resolution is drastically deteriorated. The reason for this is that a deflection magnetic field DY by the deflection yoke produces the convex-lens action in the longitudinal direction, that is, the vertical direction and the weak concave-lens action in the lateral direction, that is, the horizontal direction, so that focus points 32 and 33 in the longitudinal direction and the lateral direction of the beam spot S differ from each other.

Then, an electron gun having the above-mentioned construction as shown in FIG. 5 has been proposed.

Figure 6A:
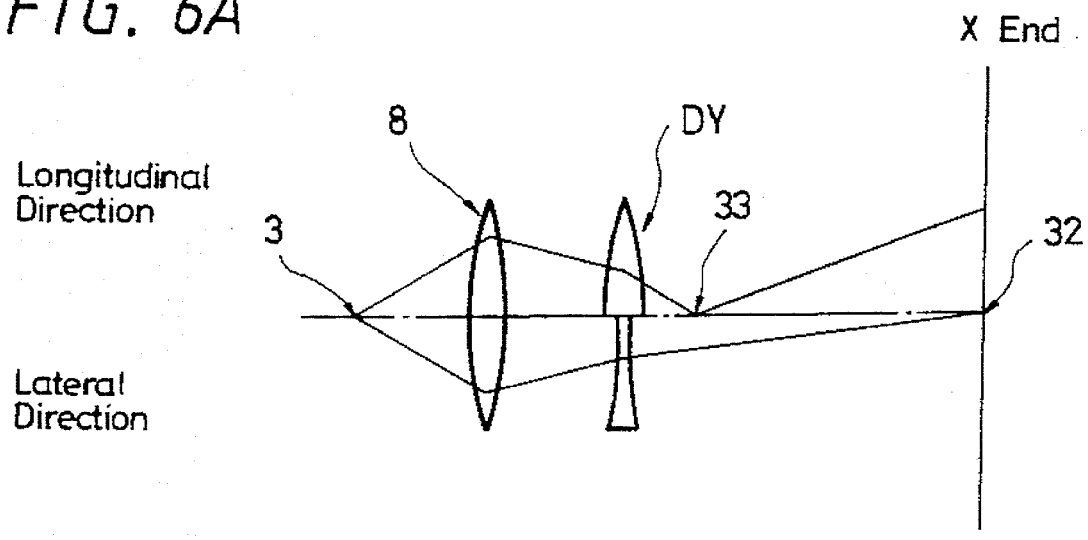
FIGS. 6A–C are explanatory diagrams showing positional relations among a main-lens electric field, a quadrupole-lens electric field and a deflection magnetic field according to the first embodiment and the prior art.
Figure 6B:
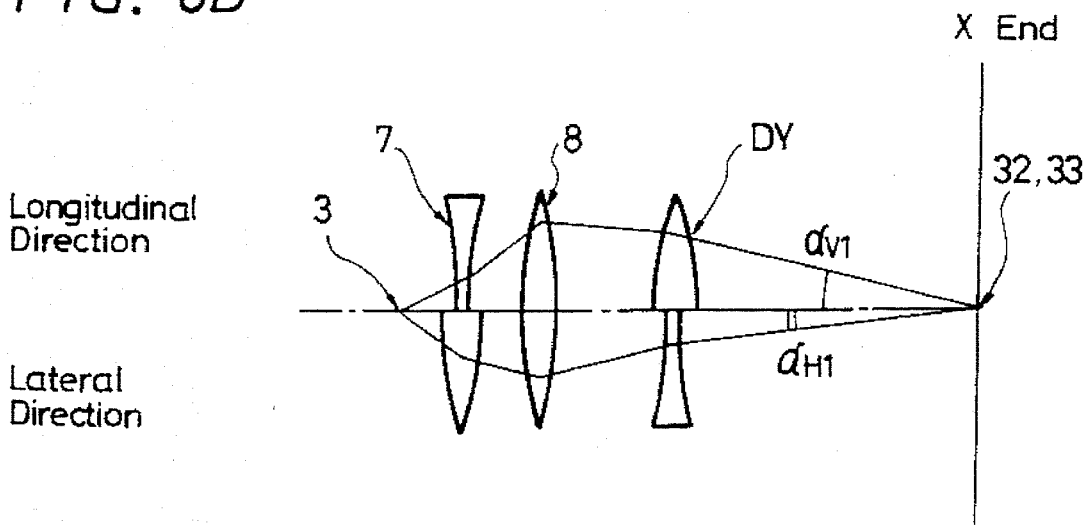

That is, in such electron gun, as shown in FIG. 6B, the quadrupole-lens electric field 7 having reverse-direction astigmatism action which cancels the astigmatism action produced by the deflection magnetic field DY is formed-on the side of the cathode 3 relative to the main lens electric field 8 and modulated by the pseudo-parabolic voltage which is supplied from the side of a stem (not shown) and synchronized with the deflection period.

Figure 7B:
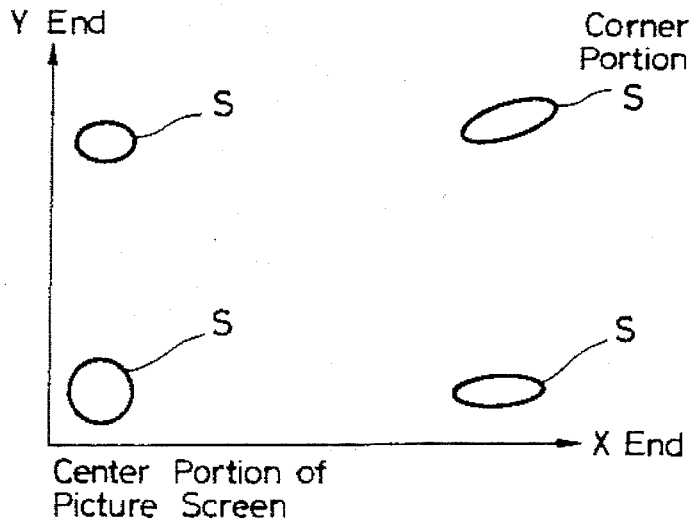
FIG. 7B (PRIOR ART)

Therefore, as shown in FIG. 7B, the astigmatism of the electron beam can be removed.

However, in this case, as shown in FIG. 6B, the deflection magnetic field DY, which is a generation source of the astigmatism, and the quadrupole-lens electric field 7 for canceling the astigmatism are located away from each other, so that center of the synthesized lens system including the main-lens electric field 8 largely differs from each other between the longitudinal and lateral direction. As a a difference in magnification of the image is caused.

That is, in FIG. 6B, reciprocal numbers of collection angles represented by $\alpha_{VI}$ and $\alpha_{HI}$ are in proportion to a focus magnification of the optics. In this case, $\alpha_{VI}>\alpha_{HI}$ is established. Therefore, as shown in FIG. 7B, a correction method according to the prior art causes laterally oblong deformation of the beam spot S at the peripheral portion of the picture screen and is encountered by the problems of deterioration of the resolution in the horizontal direction, the lowering of color purity caused by luminance saturation, interference with a mask because of extremely small size in the longitudinal direction, or the like.

In order to overcome these disadvantages, the present embodiment is made to set the generation source of the astigmatism and the correction point as close to each other as possible and to operate them.

Figure 6C:
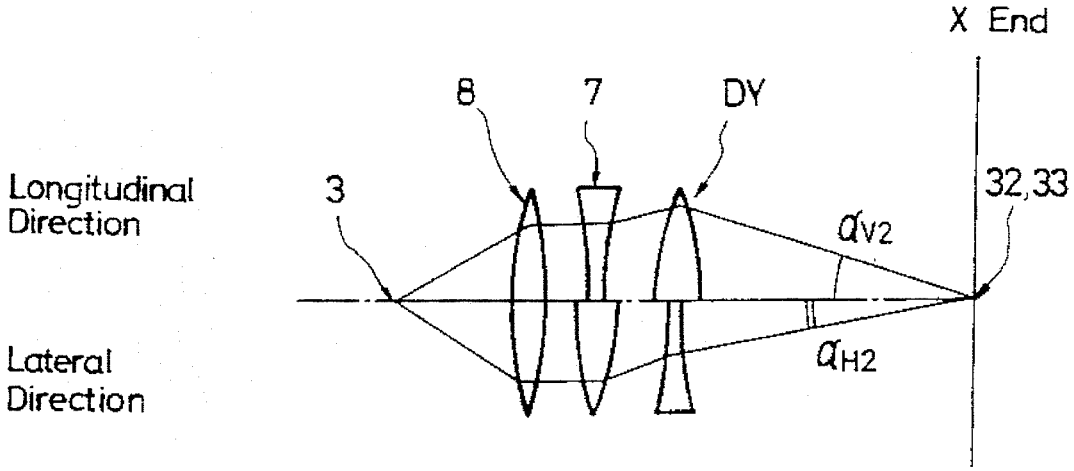

That is, in case of the present embodiment, as shown in FIGS. 1A and 6C, the quadrupole-lens electric field 7 which is dynamically modulated is formed on the side of the deflection magnetic field DY produced by the deflection yoke relative to the main-lens electric field. Such arrangement enables a ratio of $\alpha_{VI}$ to $\alpha_{HI}$ to be made closer to 1 and enables the shape of the beam spot S to be made closer to a perfect circle than the prior art shown in FIG. 5. This fact can be proved as follows.

Figure 8A:
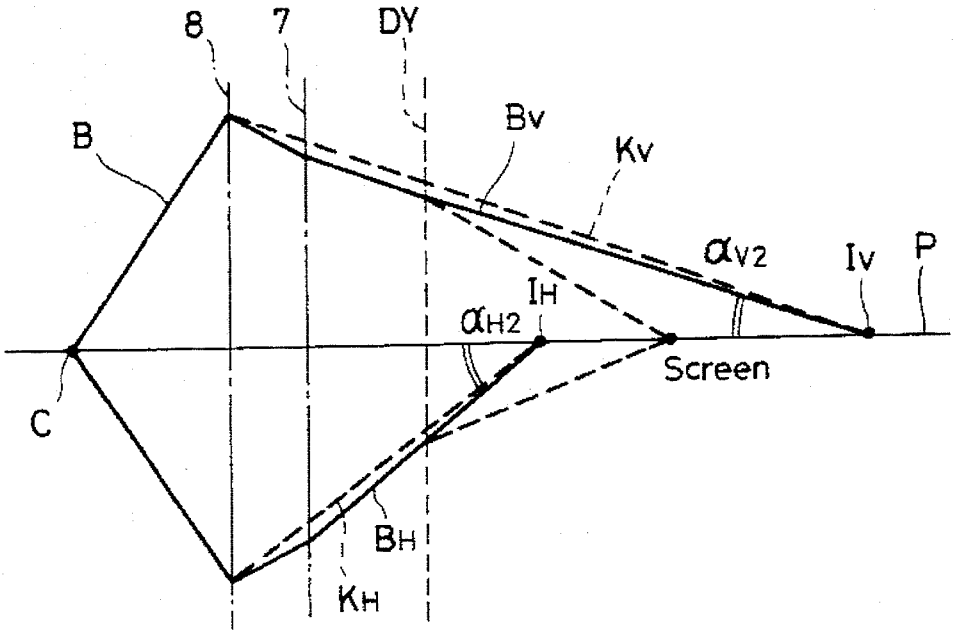
FIGS. 8A–B are explanatory diagrams showing a principle of the first embodiment.

First, as shown in FIGS. 8A and B, a position of the deflection yoke is common in the prior art and the present embodiment, so that positions of ideal object points $I_v$ and $I_H$ in view of the deflection yoke in the case where the beam can be focused in the longitudinal and lateral directions at the same time are also common in both of them.

FIG. 8A shows the case of the present embodiment. The electron beam passed through the quadrupole-lens electric field 7 travels straight toward the ideal object points $I_v$ and $I_H$. At this time, since the quadrupole-lens electric field 7 in the longitudinal direction is a concave lens, an envelope B of the electron beam in the longitudinal direction is located on the side of an axis P relative to a broken line $K_v$ drawn from the main-lens electric field 8 directly to the ideal object point $I_v$.

Contrary to this, since the quadrupole-lens electric field 7 in the horizontal direction is a convex lens, an envelope $B_H$ in the horizontal direction is located outside a broken line $K_H$ drawn from the main-lens electric field 8 directly to the ideal object point $I_H$.

Figure 8B:
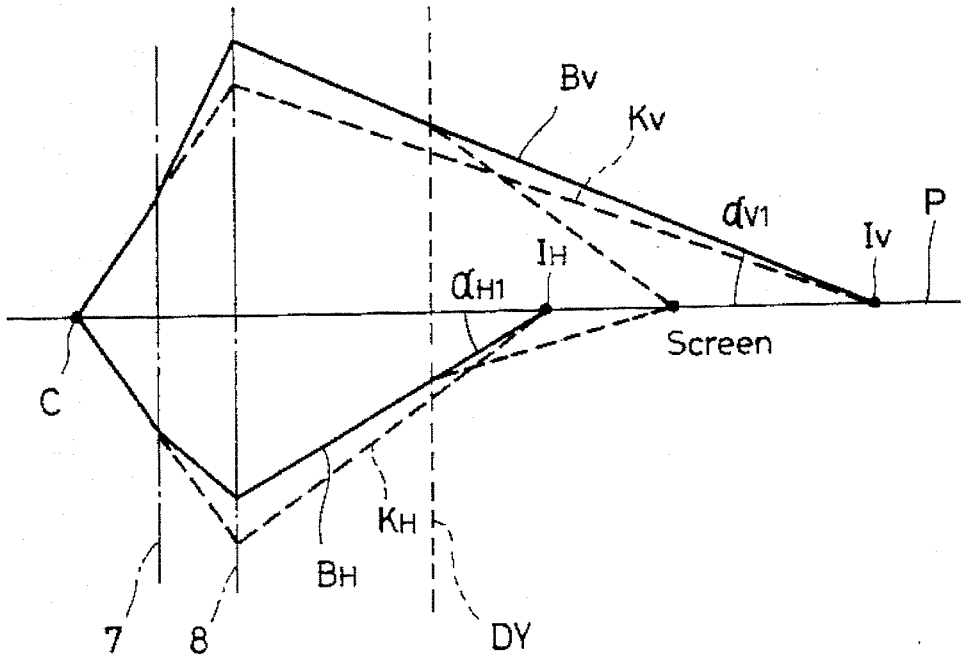

On the other hand, FIG. 8B shows the prior art. This case is different from the embodiment of the present application.

That is, the following relations are established between the collection angles $\alpha_{v2}$ and $\alpha_{v1}$ and between $\alpha_{H2}$ and $\alpha_{H1}$ of the electron beam;

$$\alpha_{v2}<\alpha_{v1} \text{ and } \alpha_{H2}>\alpha_{H1}.$$

Therefore, it can be understood that the present embodiment has such an effect that a spot diameter in the vertical direction is made larger and a spot diameter in the horizontal direction is made smaller as compared with the prior art, with the result that the shape of the beam spot S deformed in the horizontal direction can be made closer to a perfect circle.

Figure 7C:
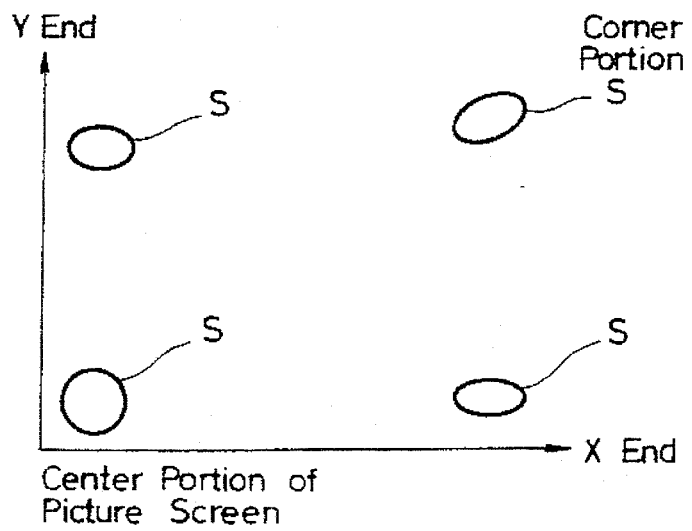

In this case, if the dynamically modulated quadrupole-lens electric field 7 is formed at a position of the deflection yoke and a power received from the deflection magnetic field DY thereof can be completely canceled, then the beam spot S becomes perfectly circular. However, a place where the deflection yoke can be provided is physically limited, the above attempt cannot be realized. However, if the dynamically modulated quadrupole lens electric field 7 is disposed at least between the main-lens electric field 8 and the deflection magnetic field DY produced by the deflection yoke, then a sufficient correction effect can be obtained within a realistic range as shown in FIG. 7C.

As described above, according to the present embodiment, the shape of the beam spot upon the correction can be made closer to a perfect circle and the resolution of the picture can be improved. Further, according to the present embodiment, correction efficiency performed by the dynamically modulated quadrupole-lens electric field 7 is increased, so that the dynamic voltage can be lowered and the circuit becomes inexpensive.

While the dynamic voltage is supplied through the capacitor formed of the neck glass or the like in the above-mentioned embodiment, the present invention is not limited thereto and the dynamic voltage may be supplied through a coaxial cable from a coaxial button provided at a funnel of the tube, for example.

Figure 9:
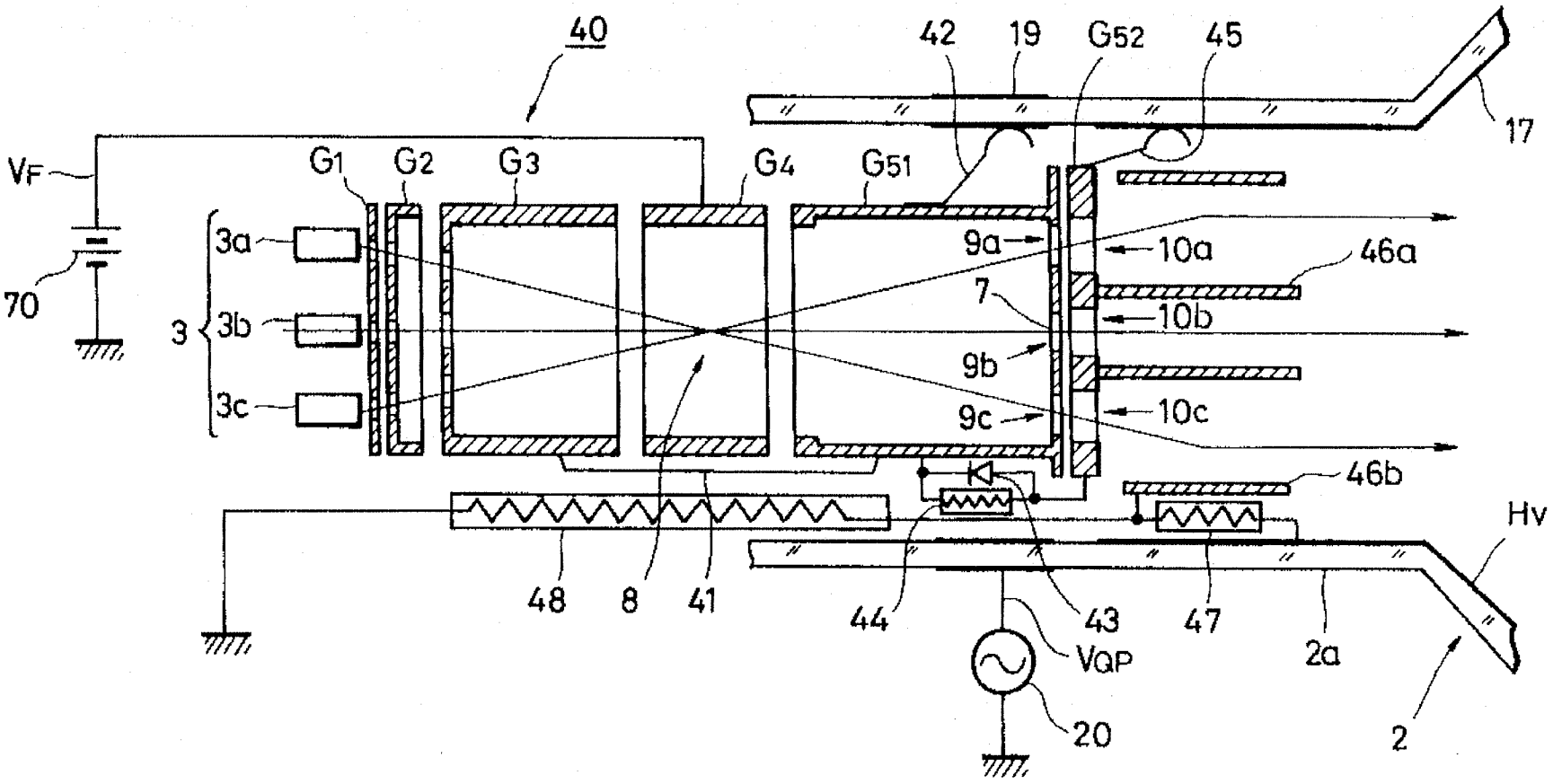
FIG. 9 is a cross-sectional view showing construction of the second embodiment according to the present invention.

FIG. 9 shows the second embodiment of the present invention where the present invention is applied to a Trinitron (registered trademark) type electron gun. The second embodiment will hereinafter be explained with giving the same reference numerals to portions corresponding to those of the first embodiment.

In an electron gun 40 according to the present embodiment, the first to fifth grids $G_1$ to $G_5$ are disposed along the same axis on the screen side relative to the cathode 3. The fifth grid $G_5$ at the final stage is divided into first and second electrodes $G_{51}$ and $G_{52}$. The fourth grid $G_4$ is connected to a direct-current power source 70, and the third grid $G_3$ and one electrode $G_{51}$ forming the fifth grid $G_5$ are connected to each other through a lead 41. The electrode $G_{51}$ is connected through a connection member 42 to the above-mentioned neck capacitor 19. Further, the electrodes $G_{51}$ and $G_{52}$ are connected to each other through a circuit formed by connecting a diode 43 and a resistor 44 in parallel. In this case, the anode of the diode 43 is connected to the electrode $G_{52}$, and the cathode thereof is connected to the electrode $G_{51}$. Further, the above-mentioned opening portions 9 and 10, for used for forming the quadrupole-lens electric field 7 are provided through portions of the electrodes $G_{51}$ and $G_{52}$ which are opposed to each other.

The electrode $G_{52}$ is connected to the inside conductive film 17 through a connection member 45. Also, one electrode of a convergence plate 46*a* which is partially made integral with the electrode $G_{52}$ is disposed on the screen side of the electrode $G_{52}$, and the other convergence plate 46*b* is connected to resistors 47 and 48 for supplying a convergence voltage.

Figure 11A:
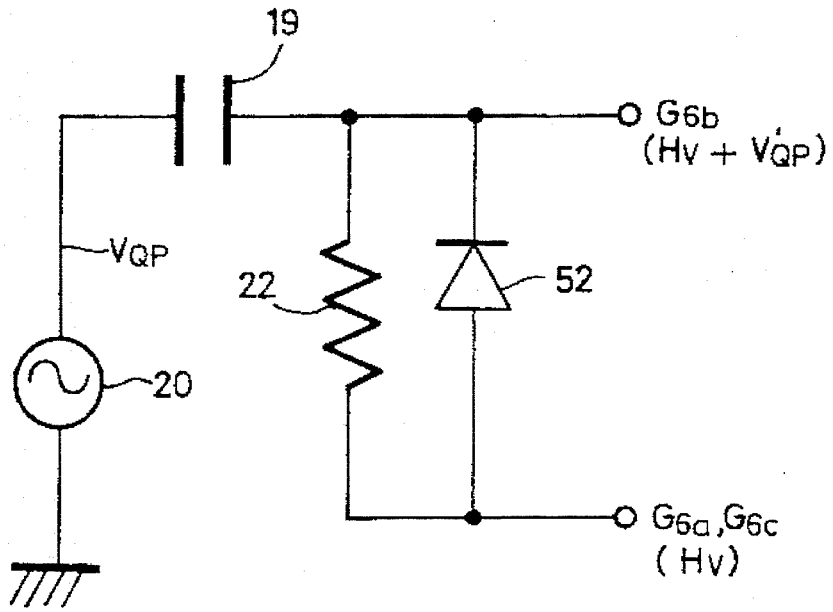
FIG. 11A is a diagram of an equivalent circuit of a dynamic-voltage supply circuit according to the third embodiment.

Even in the present embodiment having such arrangement, the dynamically modulated quadrupole-lens electric field 7 is disposed on the screen side relative to the main-lens electric field 8 formed by the third to fifth grids $G_3$ to $G_5$, so that the same effect as the first embodiment can be obtained. As shown in FIG. 11C which will be described later, the modulated voltage $V'_{QP}$ supplied to the electrode $G_{51}$ may be set in such a manner that it is higher than the anode voltage $H_v$ at the center portion of the picture screen and becomes lower than that at the center portion as the peripheral portion of the picture screen is reached. In this case, a bias amount of a quadrupole effect produced at the center portion of the picture screen can be canceled by a quadrupole magnet provided outside the neck portion 2*a*, for example, or the like. Another construction and action are the same as those of the above-mentioned embodiment, so that detailed explanation thereabout will be omitted.

Figure 10:
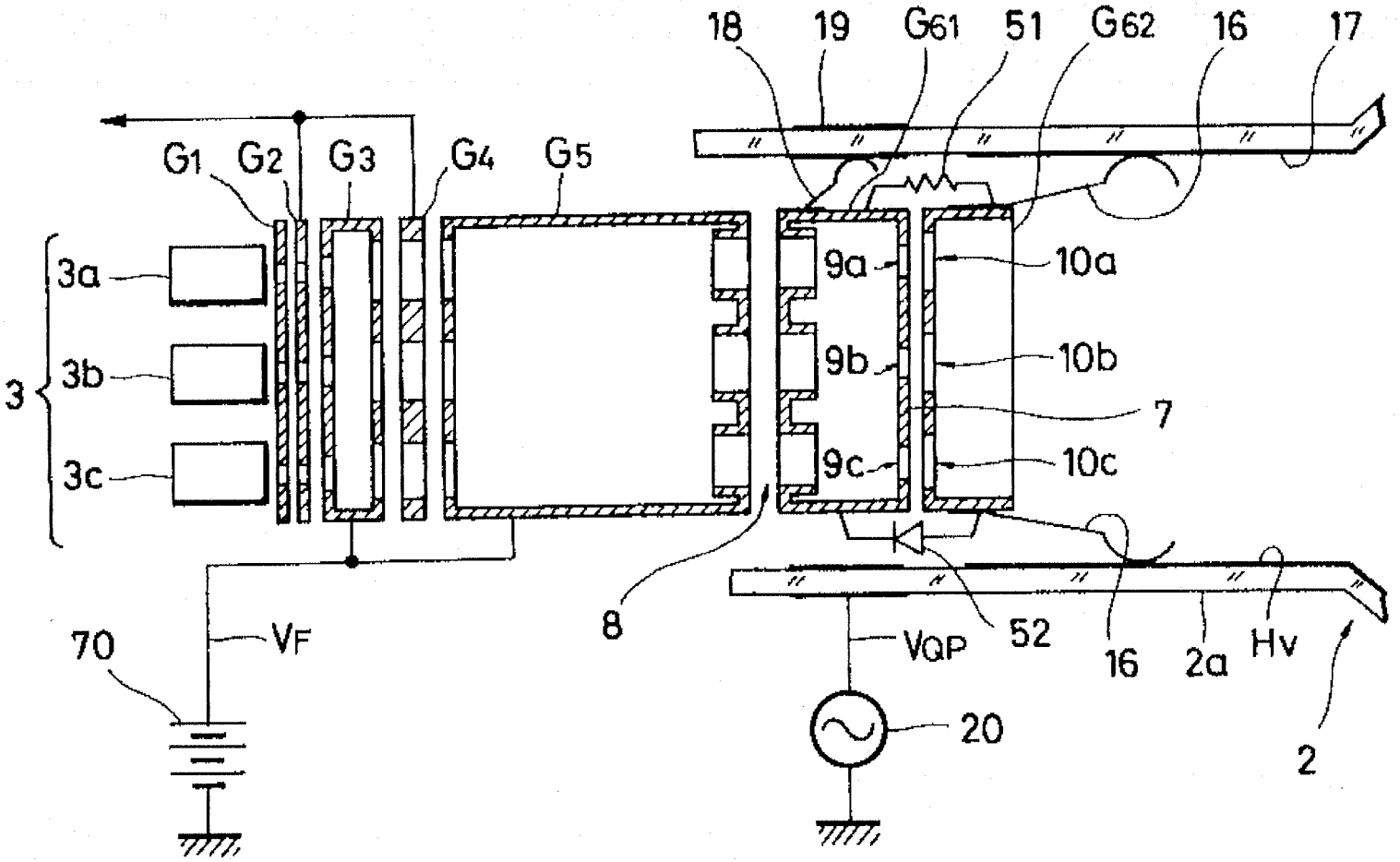
FIG. 10 is a cross-sectional view of construction of the third embodiment according to the present invention.

FIG. 10 shows construction according to the third embodiment of the present invention, which will hereinafter be explained with giving the same reference numerals to portions corresponding to those of the above-mentioned embodiment.

As shown in FIG. 10, in the present embodiment, the cathode 3 and the first to fifth grids $G_1$ to $G_5$ which are similar to those of the first embodiment shown in FIG, 1 are disposed, and further the sixth grid $G_6$ is formed of two electrodes $G_{61}$ and $G_{62}$. The above-mentioned opening portions 9*a* to 9*c* and 10*a* to 10*c* for forming the quadrupole-lens electric field 7 are respectively formed through the portions of the electrodes $G_{61}$ and $G_{62}$ which are opposed to each other. The electrodes $G_{61}$ and $G_{62}$ are connected through a resistor 51 and a diode 52. In this case, a terminal on the anode side of the diode 52 is connected to the electrodes $G_{62}$, and a terminal on the cathode side thereof is connected to the electrode $G_{61}$. Further, the electrode $G_{62}$ on the screen side is connected to the inside conductive film 17 through the connection member 16, and the electrode $G_{61}$ on the cathode 3 side is connected to the above-mentioned neck capacitor 19 through the connection member 18. An equivalent circuit thereof is shown in FIG. 11A. In case of the present embodiment, the third and fifth grids $G_3$ and $G_5$ are connected to the direct-current power source 70.

In the present embodiment, the main-lens electric field 8 is formed by the fifth grid $G_5$ and the electrode $G_{61}$, and further the cathode-3-side electrode $G_{61}$ of the electrodes $G_{61}$ and $G_{62}$ is modulated to thereby form the dynamically modulated quadrupole-lens electric field 7 on the screen side relative to the main-lens electric field 8.

Figure 11B:
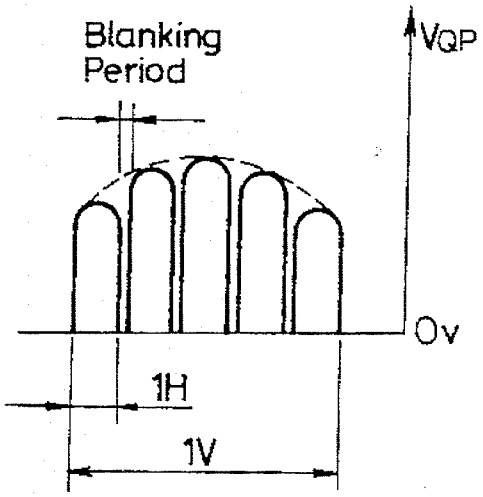
FIG. 11B is a diagram of an input waveform of the above dynamic-voltage supply circuit.
Figure 11C:
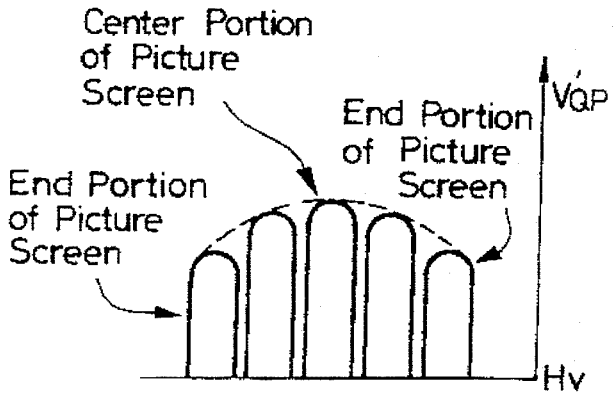
FIG. 11C is a diagram of an output waveform of an electrode $G_{61}$ of the above dynamic-voltage supply circuit.

FIGS. 11B and C show an input waveform and an output waveform of the dynamic voltage supplied to the electrode $G_{61}$. As shown in FIG. 11C, an output of the electrode $G_{61}$ is set in such a manner that it is higher than the anode voltage $H_v$ at the center portion of the picture screen and becomes lower than that at the center portion as the peripheral portion of the picture screen is reached. The voltage having such waveform is output, whereby in the quadrupole-lens electric field 7, the concave-lens action in the longitudinal direction becomes stronger at the peripheral portion of the picture screen than at the center portion of the picture screen and the convex-lens action in the longitudinal direction of the deflection magnetic field DY produced by the deflection yoke can be canceled.

Displacement at the center portion of the picture screen of the quadrupole bias voltage in case of absence of the deflection yoke can be improved by adjusting the shape of the opening portions on the side of the main lens of the electrode $G_{61}$, whereby the shape of the spot at the center portion of the picture screen can be made closer to the perfect circle.

As shown in FIG. 10, the main-lens electric field 8 is formed by the fifth grid $G_5$ and the electrode $G_{61}$, so that change of potential of the electrode $G_{61}$ means change of intensity of the main-lens electric field 8. In a usual case, the voltage of the fifth grid $G_5$ which is the focus electrode is set to about 30% of the voltage of the electrode $G_{61}$ which is the anode side electrode. Therefore, if the anode-side voltage is dynamically modulated as in the present embodiment, then a dynamic focus effect thereof becomes small by an amount of a voltage ratio.

When the focus voltage is modulated in a normal manner, for example, then if it is assumed that the necessary dynamic voltage is 500 V, then a voltage of about 1500 V which is about three times as much as the dynamic voltage is required in order to obtain an effect more similar to that obtained by modulation of the anode-side voltage.

However, the usual modulation of a comparatively high voltage of about 10 KV is not performed. It is sufficient to perform modulation with employing 0 V as a reference as shown in FIG. 11B, so that a circuit arrangement becomes rather simplified. If the shapes of the respective opening portions 9 and 10 of the electrodes $G_{61}$ and $G_{62}$ are set so that there should be obtained the dynamic quadrupole effect just necessary for the applied voltage, then the dynamic focus voltage and the dynamic quadrupole voltage can be modulated by signals having the same waveform.

As described above, according to the present embodiment, it is not necessary to supply the dynamically modulated and comparatively high voltage from the stem, so that in addition to the effect of the first embodiment, simplification of the electron gun and a circuit arrangement thereof enables production costs thereof to be drastically lowered. Another construction and action of the present embodiment are the same as those of the above-mentioned embodiment, so that detailed explanation thereabout will be omitted.

Figure 12:
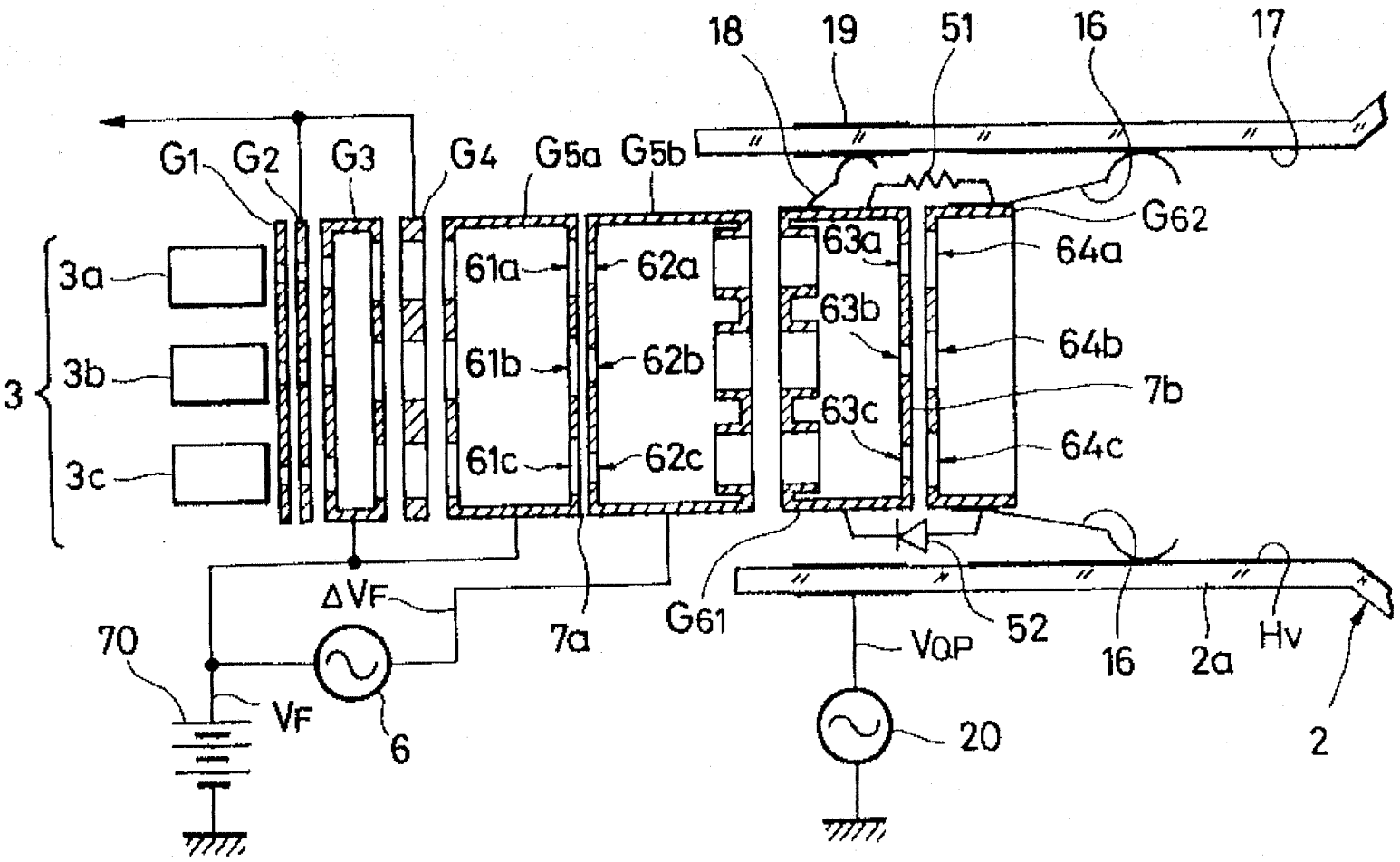
FIG. 12 is a cross-sectional diagram showing construction of the fourth embodiment according to the present invention.

FIG. 12 shows construction of the fourth embodiment of the present embodiment. The present embodiment is an embodiment in which two dynamically modulated quadrupole-lens electric fields are combined. The present embodiment will hereinafter be explained by giving the same reference numerals to portions common to the above-mentioned embodiment.

As shown in Japanese Laid-open Patent Publication No. 93135/1991, there has been proposed an electron gun in which two dynamic quadrupole-lens electric fields are provided on the cathode side of the main-lens electric field and polarities thereof are inverted to thereby make the spot shape at the periphery of the picture screen closer to the perfect anode.

However, such electron gun is encounters by two problems.

First, although the spot shape at the periphery of the picture screen becomes closer to a perfect circle, it results mainly from an effect in which a length of the beam spot in the longitudinal direction becomes long, but a length thereof in the lateral direction does not become so short. Therefore, the resolution in the lateral direction at the periphery of the picture screen is kept deteriorated as compared with the resolution at the center portion of the picture screen and is not improved.

Secondarily, a necessary dynamic correction voltage is increased, so that it imposes load on a circuit and leads to increase of the production costs thereof.

Therefore, as shown in FIG. 12, in the present embodiment, one dynamically modulated quadrupole-lens (preceding-stage quadrupole lens) electric field 7*a* is formed by a pair of the electrodes $G_{5a}$ and $G_{5b}$ forming the fifth grid $G_5$ in a way similar to the prior art shown in FIG. 5 and the other dynamically modulated quadrupole-lens (succeeding-stage quadrupole lens) electric field 7*b* is formed by a pair of the electronics $G_{61}$ and $G_{62}$ forming the sixth grid $G_6$, which is the final accelerating electrode, by the two electrodes $G_{61}$ and $G_{62}$ in a way similar to the third embodiment shown in FIG. 10, thereby solving the above-mentioned problems. In this case, it is constructed that shapes of respective opening portions 61 (61*a* to 61*c*), 62 (62*a* to 62*c*), 63 (63*a* to 63*c*) and 64 (64*a* to 64*d*) of the electrodes $G_{5a}$ and $G_{5b}$ and the electrodes $G_{61}$ and $G_{62}$ are adjusted to thereby invert the polarities of the quadrupole-lens electric fields 7*a* and 7*b*.

Figure 13:
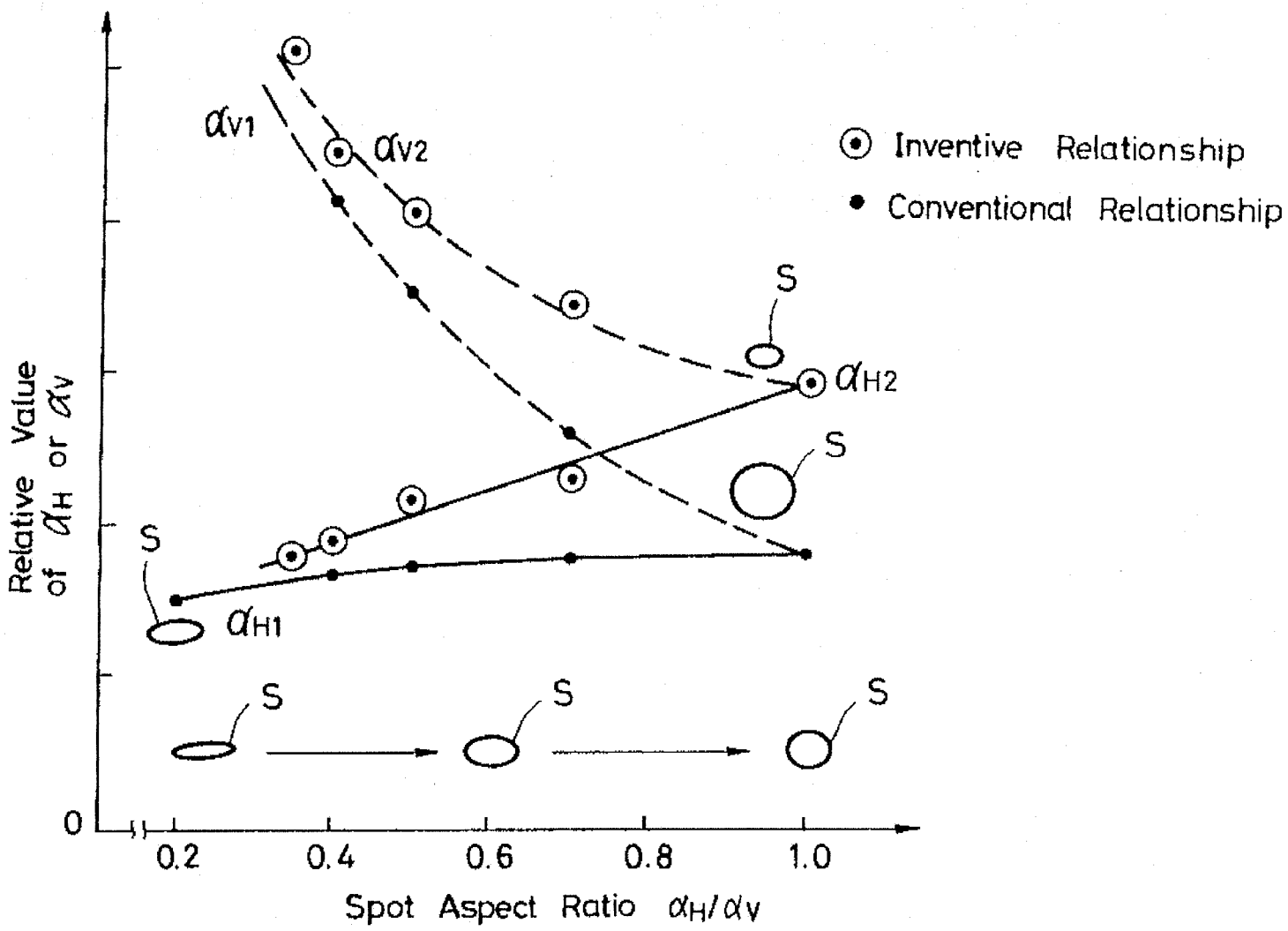
FIG. 13 is a graph showing a relation between a spot aspect ratio and a collection angle of an electron beam.
Figure 14:
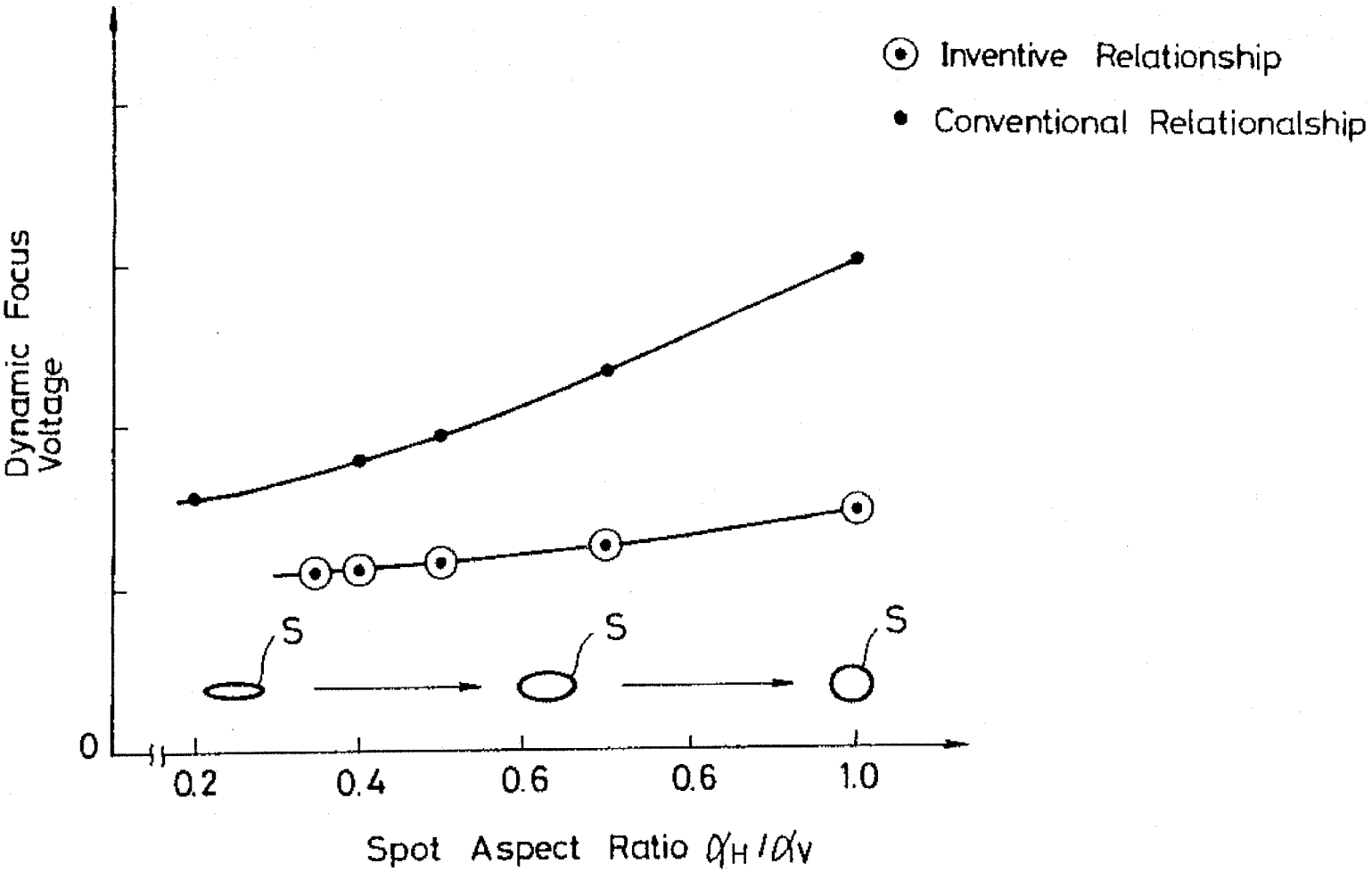
FIG. 14 is a graph showing a relation between the spot aspect ratio and a dynamic focus voltage.

FIGS. 13 and 14 show effects of the present embodiment with comparison thereof with the prior art and are graphs obtained by calculation with the chase of paraxial rays in view of the above aspect.

As shown in FIG. 13, when an aspect ratio of the beam spot S is improved to a certain value (made close to 1), it can be understood in the above-mentioned construction according to the prior art that only $\alpha_{VI}$ of the collection angle in the longitudinal direction mainly becomes small, that is, only the length of the beam spot S in the longitudinal direction becomes long.

On the other hand, in case of the present embodiment, it can be understood that the collection angle $\alpha_{v2}$ in the longitudinal direction becomes small (that is, the length of the beam spot S in the longitudinal direction becomes long) and at the same time the collection angle $\alpha_{H2}$ in the lateral direction of the beam spot S also becomes large (that is, the length of the beam spot S in the lateral direction becomes small).

As shown in FIG. 14, according to the present embodiment, it can be understood that the modulated voltage required for the dynamic focus can be reduced to half as compared with that of the prior art. Another construction and action are the same as those of the above-mentioned embodiment, so that detailed explanation thereabout will be omitted.

The present invention can be applied to both of the bi-potential type and uni-potential type electron guns.

As described above, according to the present invention, the correction-lens electric field is formed on the side of the deflection magnetic field relative to the main-lens electric field, whereby the resolution can be improved by making the shape of the beam spot closer to the perfect circle and the circuit arrangement can be simplified and the production costs can be reduced by making the necessary dynamic focus voltage small.

In this case, if the correction-lens electric field for correction of the deformation of the spot is further formed between the cathode and the main-lens electric field, then further improvement of the resolution, further simplification of the circuit arrangement and so on can be achieved.

If the dynamic voltage is supplied to the correction electrode through the capacitor formed by using the neck glass of the cathode-ray tube as the dielectric to thereby form the correction-lens electric field, then direct modulation of the high voltage on the side of the circuit is not required and hence the production costs can be drastically reduced by simplifying the circuit arrangement.

Further, if the high-voltage side electrode of the electrodes for forming the main-lens electric field is dynamically modulated to thereby form the correction-lens electric field, then modulation degree of the middle and high-voltage focus voltage supplied from the stem side can be reduced or omitted, so that the production costs of the circuit can be reduced.

In addition to the above effects, according to the present invention, the shape of the beam spot is made closer to the perfect circle, whereby there is then such an effect that the luminance saturation of the phosphor is prevented and a white uniformity is improved.

Having described preferred embodiments of the present invention with reference to the accompanying drawings, it is to be understood that the present invention is not limited to the above-mentioned embodiments and that various changes and modifications can be effected by one skilled in the art without departing from the spirit or scope of the novel concepts of the present invention as defined in the appended claims.

What is claimed is:

1. A cathode-ray tube having a cathode emitting an electron beam, a fluorescent screen, and a deflection magnetic field formed adjacent the fluorescent screen, comprising:

main-lens electric field means arranged between the cathode and the fluorescent screen for forming a main-lens electric field for focusing the electron beam on the fluorescent screen; and correction-lens electric field means for forming a correction-lens electric field and including a quadrupole lens for forming a quadrupole lens electric field dynamically modulated at a deflection period, said quadrupole lens being located between the deflection magnetic field and said main-lens electric field in order to correct a spot deformation of the electron beam resulting from said deflection magnetic field formed adjacent the fluorescent screen, wherein said quadrupole-lens means includes a first electrode, a second electrode and a third electrode each having respective opening portions for passing the electron beam from the cathode therethrough, and wherein said opening portions of said first and third electrodes have longitudinally oblong shapes for passing the electron beams therethrough and said opening portion of said second electrode has a laterally oblong shape for passing the electron beam therethrough.

2. The cathode-ray tube according to claim 1, further comprising second correction-lens electric field means for forming a second correction-lens electric field for correcting a spot deformation located between the cathode emitting the electron beam and said main-lens electric field.

3. A cathode-ray tube having a cathode emitting an electron beam, a fluorescent screen, and a deflection magnetic field formed adjacent the fluorescent screen, comprising:

main-lens electric field means arranged between the cathode and the fluorescent screen for forming a main-lens electric field for focusing the electron beam on the fluorescent screen; and correction-lens electric field means for forming a correction-lens electric field and including a quadrupole lens for forming a quadrupole lens electric field dynamically modulated at a deflection period, said quadrupole lens being located between the deflection magnetic field and said main-lens electric field in order to correct a spot deformation of the electron beam resulting from said deflection magnetic field formed adjacent the fluorescent screen, wherein said quadrupole-lens means includes a first electrode, a second electrode and a third electrode each having respective opening portions for passing the electron beam from the cathode therethrough, and wherein said opening portions of said first and third electrodes have substantially square shapes for passing the electron beams therethrough and include longitudinal-direction eaves at both sides of said opening portions and arranged between said opening portions of said first and third electrodes and said opening portion of said second electrode has a substantially square shape for passing the electron beam and respective eaves extended in the lateral direction at upper and lower sides of said opening portion of said second electrode.

4. The cathode-ray tube according to claim 3, further comprising dynamic voltage generating means, wherein said first and third electrodes are supplied with an anode voltage and said second electrode is supplied with a modulated voltage synchronized with the deflection period from said dynamic voltage generating means.

5. The cathode-ray tube according to claim 4, wherein said second electrode is supplied with the modulated voltage synchronized with the deflection period from said dynamic-voltage generating means through a capacitor at a neck portion of said cathode-ray tube.

6. The cathode ray tube according to claim 4, wherein said dynamic-voltage generating means modulates a focus voltage.

7. A cathode-ray tube having a cathode emitting an electron beam, a fluorescent screen, and a deflection magnetic field formed adjacent the fluorescent screen, comprising:

main-lens electric field means arranged between the cathode and the fluorescent screen for forming a main-lens electric field for focusing the electron beam on the fluorescent screen; and correction-lens electric field means for forming a correction-lens electric field and including a quadrupole lens for forming a quadrupole lens electric field dynamically modulated at a deflection period, said quadrupole lens being located between the deflection magnetic field and said main-lens electric field in order to correct a spot deformation of the electron beam resulting from said deflection magnetic field formed adjacent the fluorescent screen, wherein said quadrupole-lens means includes a first electrode, a second electrode and a third electrode each having respective opening portions for passing the electron beam from the cathode therethrough, and further comprising a diode and a resistor connected in parallel between one of Said first electrode and said third electrode and said second electrode.

8. A cathode-ray tube having a cathode emitting an electron beam, a fluorescent screen, and a deflection magnetic field formed adjacent the fluorescent screen, comprising:

main-lens electric field means arranged between the cathode and the fluorescent screen for forming a main-lens electric field for focusing the electron beam on the fluorescent screen; and correction-lens electric field means for forming a correction-lens electric field and including a quadrupole lens for forming a quadrupole lens electric field dynamically modulated at a deflection period, said quadrupole lens being located between the deflection magnetic field and said main-lens electric field in order to correct a spot deformation of the electron beam resulting from said deflection magnetic field formed adjacent the fluorescent screen, wherein said quadrupole-lens means includes a first electrode and a second electrode each having respective opening portions for passing the electron beam from the cathode therethrough, and further comprising a diode and a resistor connected in parallel between said first and second electrodes.

9. The cathode-ray tube according to claim 8, further comprising dynamic-voltage generating means wherein said first electrode forms a fifth grid connected to a third grid and supplied with a modulated voltage synchronized with the deflection period from said dynamic-voltage generating means through a capacitor at a neck portion of said cathode-ray tube and said second electrode is integrally formed with a convergence plate and supplied with a convergence voltage.

10. The cathode-ray tube according to claim 8, further comprising dynamic-voltage generating means wherein said first electrode and said second electrode form a fifth grid and said first electrode is supplied with a modulated voltage synchronized with the deflection period from said dynamic-voltage generating means through a capacitor at a neck portion of said cathode-ray tube.

* * * * *

UNITED STATES PATENT AND TRADEMARK OFFICE

CERTIFICATE OF CORRECTION

PATENT NO. : 5,539,285

DATED : July 23, 1996

INVENTOR(S) : Yukinobu IGUCHI, Nobuya OKANO

It is certified that error appears in the above-identified patent and that said Letters Patent is hereby corrected as shown below:

Title page, item [57],
In the Abstract, line 4, change "gun and the sixth grid (1)" to —gun (1) and the sixth grid—
line 13, change "beamspot" to —beam spot—

Col. 1 lines 61 and 62, delete "lengthen the beam spot"
line 64, after "to" insert —lengthen the beam spot—

Col. 3, line 60, change "$G_6$a" to —$G_{6a}$—
Col. 6, line 16, after "formed" delete "-"
line 29, after "a" first occurence, insert —result—
Col. 8 line 3, after "for" insert —example,—
Col. 9, line 64, change "is encounters by two" to —encounters two—

Col. 12, line 35, change "cathode ray" to —cathode-ray—
line 59, change "Said" to —said—

Signed and Sealed this

Sixth Day of May, 1997

*Attest:*

*Attesting Officer*

BRUCE LEHMAN

*Commissioner of Patents and Trademarks*